US007247786B2

(12) United States Patent
Suzuki et al.

(10) Patent No.: US 7,247,786 B2
(45) Date of Patent: Jul. 24, 2007

(54) SONG SELECTION APPARATUS AND METHOD

(75) Inventors: Yasunori Suzuki, Tsurugashima (JP); Satoshi Odagawa, Tsurugashima (JP); Yasuteru Kodama, Tsurugashima (JP); Takehiko Shioda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 152 days.

(21) Appl. No.: 11/034,851

(22) Filed: Jan. 14, 2005

(65) Prior Publication Data

US 2005/0160901 A1 Jul. 28, 2005

(30) Foreign Application Priority Data

Jan. 22, 2004 (JP) ..... P2004-014197

(51) Int. Cl.
*G10H 1/00* (2006.01)
*G10H 1/18* (2006.01)
*G10H 7/00* (2006.01)

(52) U.S. Cl. ..... 84/615; 84/601; 84/609; 84/649; 84/653

(58) Field of Classification Search ..... None
See application file for complete search history.

(56) References Cited

U.S. PATENT DOCUMENTS

| | | | | |
|---|---|---|---|---|
| 6,504,089 | B1 * | 1/2003 | Negishi et al. | 84/609 |
| 6,545,209 | B1 | 4/2003 | Flannery et al. | 84/609 |
| 6,913,466 | B2 * | 7/2005 | Stanfield et al. | 434/219 |
| 6,987,221 | B2 * | 1/2006 | Platt | 84/601 |
| 2003/0045953 | A1 | 3/2003 | Weare | 700/74 |
| 2004/0055446 | A1 * | 3/2004 | Robbin et al. | 84/615 |
| 2004/0055448 | A1 * | 3/2004 | Byon | 84/626 |
| 2005/0103189 | A1 * | 5/2005 | Suzuki et al. | 84/613 |

FOREIGN PATENT DOCUMENTS

| | | |
|---|---|---|
| JP | 10-134549 | 5/1998 |
| WO | WO 02/29610 A2 | 4/2002 |

* cited by examiner

*Primary Examiner*—Marlon Fletcher
(74) *Attorney, Agent, or Firm*—Drinker Biddle & Reath LLP

(57) ABSTRACT

A song selection device stores song characteristic quantities of a plurality of songs. A user operates the song selection device to enter personal properties and a sensibility word. The song selection device selects a song having a song characteristic quantity corresponding to the personal properties and the sensibility word. The song selection device may select a plurality of songs.

17 Claims, 8 Drawing Sheets

FIG. 2

| SENSIBILITY WORD | DEGREE OF CHORD CHANGE #1 | DEGREE OF CHORD CHANGE #2 | DEGREE OF CHORD CHANGE #3 | BEAT | MAXIMUM BEAT LEVEL | AMPLITUDE LEVEL | MAXIMUM AMPLITUDE LEVEL | KEY |
|---|---|---|---|---|---|---|---|---|
| RHYTHMICAL | Ma1, Sa1 | Mb1, Sb1 | Mc1, Sc1 | Md1, Sd1 | Me1, Se1 | Mf1, Sf1 | Mg1, Sg1 | Mh1, Sh1 |
| QUIET | Ma2, Sa2 | Mb2, Sb2 | Mc2, Sc2 | Md2, Sd2 | Me2, Se2 | Mf2, Sf2 | Mg2, Sg2 | Mh2, Sh2 |
| BRIGHT | Ma3, Sa3 | Mb3, Sb3 | Mc3, Sc3 | Md3, Sd3 | Me3, Se3 | Mf3, Sf3 | Mg3, Sg3 | Mh3, Sh3 |
| SAD | Ma4, Sa4 | Mb4, Sb4 | Mc4, Sc4 | Md4, Sd4 | Me4, Se4 | Mf4, Sf4 | Mg4, Sg4 | Mh4, Sh4 |
| SOOTHING | Ma5, Sa5 | Mb5, Sb5 | Mc5, Sc5 | Md5, Sd5 | Me5, Se5 | Mf5, Sf5 | Mg5, Sg5 | Mh5, Sh5 |
| LONELY | Ma6, Sa6 | Mb6, Sb6 | Mc6, Sc6 | Md6, Sd6 | Me6, Se6 | Mf6, Sf6 | Mg6, Sg6 | Mh6, Sh6 |

FIG. 5

| AGE / GENDER | TEENS | 20'S | 30'S | 40'S | 50 AND OVER |
|---|---|---|---|---|---|
| MALE | DATA TABLE FOR TEEN MALES | DATA TABLE FOR 20'S MALES | DATA TABLE FOR 30'S MALES | DATA TABLE FOR 40'S MALES | DATA TABLE FOR MALES 50 AND OVER |
| FEMALE | DATA TABLE FOR TEEN FEMALES | DATA TABLE FOR 20'S FEMALES | DATA TABLE FOR 30'S FEMALES | DATA TABLE FOR 40'S FEMALES | DATA TABLE FOR FEMALES 50 AND OVER |

FIG. 8

| SENSIBILITY WORD | DEGREE OF CHORD CHANGE #1 | DEGREE OF CHORD CHANGE #2 | DEGREE OF CHORD CHANGE #3 | BEAT | MAXIMUM BEAT LEVEL | AMPLITUDE LEVEL | MAXIMUM AMPLITUDE LEVEL | KEY |
|---|---|---|---|---|---|---|---|---|
| RHYTHMICAL | M' a1, S' a1 | M' b1, S' b1 | M' c1, S' c1 | M' d1, S' d1 | M' e1, S' e1 | M' f1, S' f1 | M' g1, S' g1 | M' h1, S' h1 |
| QUIET | M' a2, S' a2 | M' b2, S' b2 | M' c2, S' c2 | M' d2, S' d2 | M' e2, S' e2 | M' f2, S' f2 | M' g2, S' g2 | M' h2, S' h2 |
| BRIGHT | M' a3, S' a3 | M' b3, S' b3 | M' c3, S' c3 | M' d3, S' d3 | M' e3, S' e3 | M' f3, S' f3 | M' g3, S' g3 | M' h3, S' h3 |
| SAD | M' a4, S' a4 | M' b4, S' b4 | M' c4, S' c4 | M' d4, S' d4 | M' e4, S' e4 | M' f4, S' f4 | M' g4, S' g4 | M' h4, S' h4 |
| SOOTHING | M' a5, S' a5 | M' b5, S' b5 | M' c5, S' c5 | M' d5, S' d5 | M' e5, S' e5 | M' f5, S' f5 | M' g5, S' g5 | M' h5, S' h5 |
| LONELY | M' a6, S' a6 | M' b6, S' b6 | M' c6, S' c6 | M' d6, S' d6 | M' e6, S' e6 | M' f6, S' f6 | M' g6, S' g6 | M' h6, S' h6 |

SONG SELECTION APPARATUS AND METHOD

BACKGROUND OF THE INVENTION

1. Field of the Invention

This invention relates to a device and method for selecting a song from among a plurality of songs.

2. Description of the Related Art

In one method of selecting a song matching the preferences of a user from a plurality of songs, the physical characteristics of songs are extracted beforehand as data, the songs are classified according to the extraction results, and the classifications are used in song selection. The physical characteristic data of a song is, for example, power spectrum data obtained from the song data. Such song selection method is disclosed in Japanese Patent Kokai (Laid-open application) No. 10-134549. Another physical characteristic data of a song is a pattern (i.e., change with time) of frequency bandwidth, lengths of sounds, and musical score of the song, which are prepared by an N-gram method.

These song selection methods, however, cannot always select the song expected by the user because the physical characteristic data does not necessarily have a correlation with the sensitivities and preferences of the user.

SUMMARY OF THE INVENTION

One object of this invention is to provide a song selection apparatus capable of presenting songs appropriate to the sensitivities of the user.

Another object of this invention is to provide a song selection method capable of presenting songs appropriate to the sensitivities of the user.

According to one aspect of the present invention, there is provided an improved song selection apparatus for selecting one or more songs from among a plurality of songs according to an input operation by a user. The song selection apparatus includes a storage for storing a song characteristic quantity for each of the songs. The song selection apparatus also includes a first setting unit for setting personal properties (e.g., age and gender) according to the input operation. The song selection apparatus also includes a second setting unit for setting a sensibility word according to the input operation. The song selection apparatus also includes a selector for finding (or selecting) one or more songs having song characteristic quantities corresponding to the personal properties set by the first setting unit and to the sensibility word set by the second setting unit.

Songs conforming to the user's personal properties such as age and gender and his/her sensitivity (sensibility) can be presented to the user, so that song selection by the user becomes easy.

According to a second aspect of the present invention, there is provided a song selection method for selecting one or more songs from among a plurality of songs according to an input operation by a user. Song characteristic quantities are stored in a memory for each of the songs. Personal properties are determined according to the user input operation. A sensibility word is also determined according to the user input operation. One or more songs are found (selected) having song characteristic quantities corresponding to the personal properties and the sensibility word.

Songs conforming to the user's personal properties such as age and gender, and to his/her sensitivity (sensibility) can be presented to the user, so that song selection by the user becomes easy.

These and other objects, aspects and advantages of the present invention will become apparent to those skilled in the art from the detailed description and appended claims when read and understood in conjunction with the attached drawings.

BRIEF DESCRIPTION OF THE DRAWINGS

FIG. 2 shows one data table within a default database;

FIG. 5 shows a table for data table selection;

DETAILED DESCRIPTION OF THE INVENTION

An embodiment of this invention is described below in detail, referring to the attached drawings.

Figure 1:
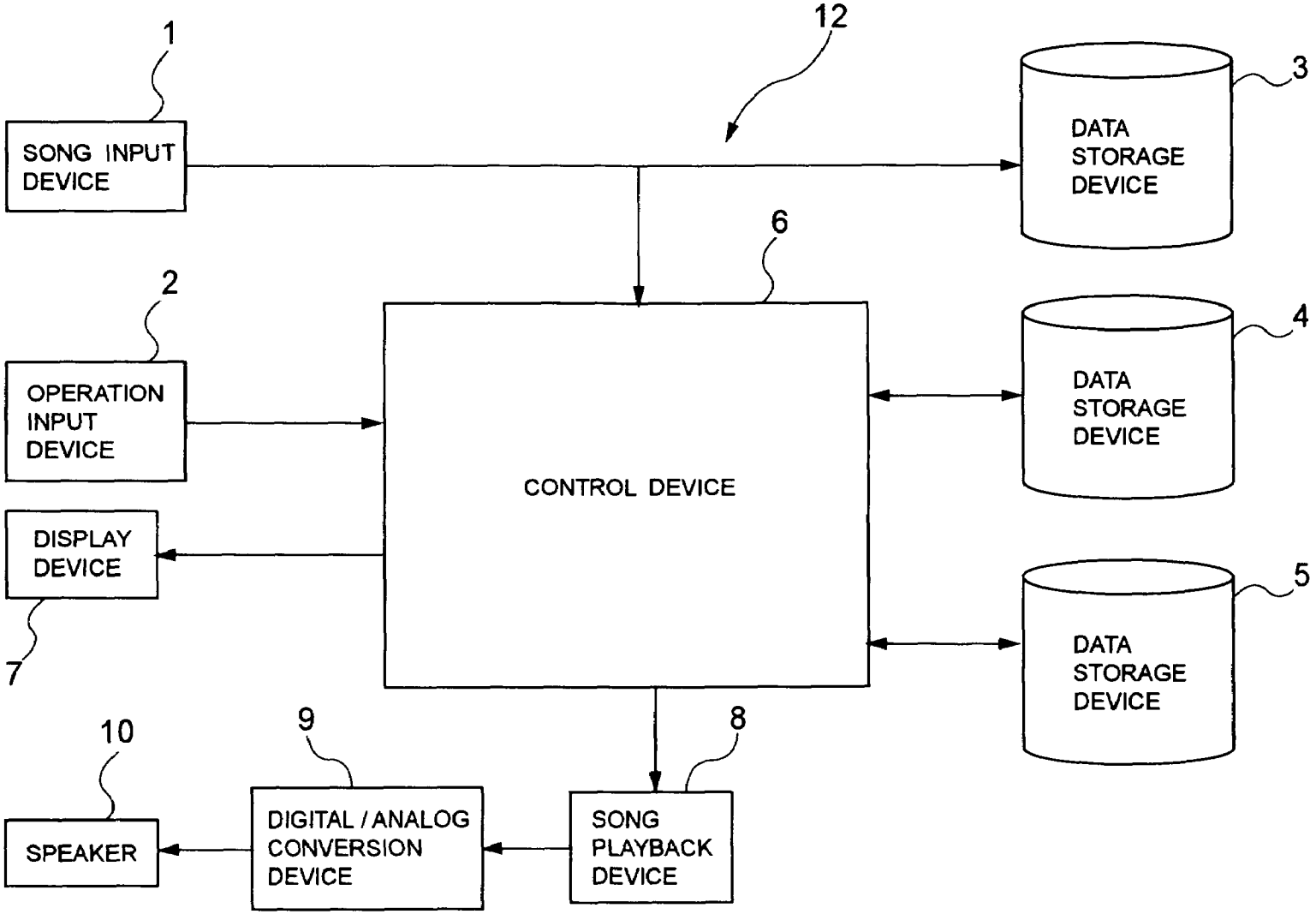
FIG. 1 is a block diagram of a song selection apparatus according to one embodiment of the present invention.

Referring to FIG. 1, a song selection apparatus 12 includes a song/music input device 1, operation input device 2, data storage devices 3, 4 and 5, control device 6, display device 7, song reproduction (playback) device 8, digital-analog conversion device 9, and speaker(s) 10.

The song/music input device 1 is connected to the control device 6 and data storage device 3, and is used to input audio signals, for example, PCM data of digitized songs to the song selection apparatus 12. The song input device 1 may be, for example, a disc player which plays CDs or other discs, or a streaming interface which receives streaming distribution of song data. The operation input device 2 is operated by a user to input data, information, instructions and commands into the song selection apparatus 12. The operation input device 2 is provided with such buttons as alphanumeric buttons, a "YES" button, "NO" button, "END" button, and "NEXT SONG" button. The output of the operation input device 2 is connected to the control device 6. It should be noted that the button types of the operation input device 2 are not limited to the above-described buttons.

The data storage device 3, which is the third storage, stores, in the form of files, song data provided by the song input device 1. Song data is data of reproduction sounds of a song, and may be, for example, PCM data, MP3 data, or MIDI data. The song name, singer name, and other song information is stored for each song in the data storage device 3. Song data for n songs (where n is greater than one) is stored in the data storage device 3. The data storage device 4 stores character parameters of the n songs (or n song data) in a characteristic parameter database (first storage). The characteristic parameters include the degree of chord change #1, degree of chord change #2, degree of chord change #3, beat (number of beats per unit time), maximum beat level, mean amplitude level, maximum amplitude level, and the key. The degree of chord change #1 is the number of chords per minute in the song; the degree of chord change #2 is the number of types of chords used in the song; and the degree of chord change #3 is the number of impressive points, such as discord, which give a certain impression to a listener during the chord progression.

Chords themselves have elements which may provide depth to a song, or impart a sense of tension to the listener, or similar. A song may be provided with atmosphere through a chord progression. Chords having such psychological elements are optimal as song-characterizing quantities used by the song selection apparatus 12 to select songs based on sensibility words (impression words). The chords provide not only the characteristics of the melody but also the intentions of the composer, including the meaning of the lyrics, to some extent; hence, the chords are used in the characteristic parameters.

Predetermined sensibility words are stored in the data storage device 4. For each of these sensibility words are stored, as the default database (second storage means), mean values and unbiased variances of the respective characteristic parameters. The database includes a plurality of data tables corresponding to a plurality of age-gender classifications. The characteristic parameters include, as mentioned earlier, the degree of chord change #1, degree of chord change #2, degree of chord change #3, beat, maximum beat level, mean amplitude level, maximum amplitude level, and the key. The mean values and unbiased variances are correction values used together with the characteristic parameters to compute sensitivity (sensibility) conformance values. Mean values and unbiased variances will be described later. As shown in FIG. 5, user ages are divided into teens, 20's, 30's, 40's, and 50 and older, and these age groups are associated with gender to make five data tables for males and five data tables for females. In this embodiment, therefore, there are prepared ten age-gender classifications and ten data tables.

FIG. 2 shows one of such data tables. As depicted, the mean values and unbiased variances of the characteristic parameters for the respective sensibility words are stored in the table format.

The "sensibility words (impression words)" are words expressing feelings felt when a human listens to a song. For example, "rhythmical", "quiet", "bright", "sad" "soothing (healing)", and "lonely" are the sensibility words.

A matching song database (fourth storage means) and nonmatching song database (sixth storage means) are formed in the data storage device 5. In each of these databases is stored 50 song data for each sensibility word. When song data for more than 50 songs is to be written, the new data is written while erasing the oldest data. It should be noted that the number of songs stored for each sensibility word in the matching song database and in the nonmatching song database is not limited to 50, but may be a different number.

The control device 6 includes for example a microcomputer, and performs song selection operation according to an input operation by a user (will be described).

The display device 7 displays selection items/fields of the control by the control device 6, the song contents entered from the song input device 1, and a list of songs presented to the user.

The playback device 8 reads and plays back song data for a song selected by the user from the data storage device 3, and outputs the data sequentially as digital audio signals to the digital/analog converter 9. The digital/analog converter 9 converts the digital audio signals into analog audio signals, and supplies the analog audio signals to the speaker 10.

Figure 3:
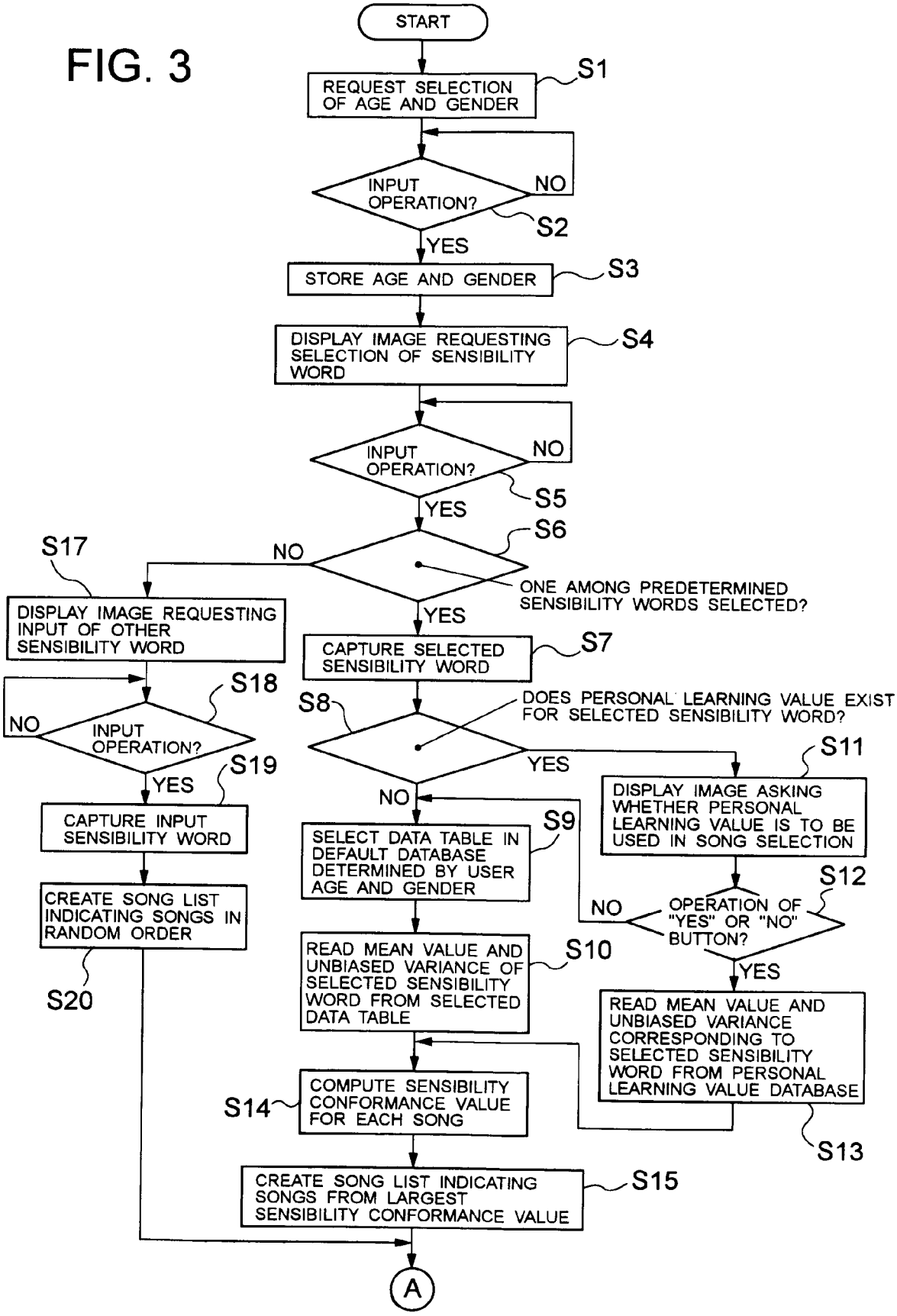
FIG. 3 and FIG. 4 show in combination a flowchart of song selection operation.

Next, song selection operation in the song selection apparatus 12 having the above described configuration is described with reference to FIG. 3. In this embodiment, it is assumed that a single user uses the song selection apparatus 12; if a plurality of users share the song selection apparatus, a user may input his/her ID code via the operation input device 2 when starting the song selection operation. The user ID code is used to determine whether this user utilizes his/her own personal learning values (will be described). It should be noted that when a single user uses the song selection apparatus 12, the user also has an option to use or not his/her personal learning values if the personal learning values are available.

When song selection operation begins, the control device 6 first causes the display device 7 to display an image in order to request selection of the user's age and gender, as shown in step S1. On the screen of the display device 7 are displayed, as selection options for age and gender, i.e., teens, 20's, 30's, 40's, 50 or older, mail and female. An instruction for the user to select one from the options for age and one from the options for gender is displayed. The user can perform an input operation, via the operation input device 2, to input the user's own age and gender according to this display. After execution of step S1, the control device 6 determines whether there has been input from the user through the input device 2 (step S2). If there has been input, the input content, that is, the user's age and gender, are stored (step S3), and the display device 7 is caused to display an image requesting selection of a sensibility word (step S4). As sensibility words for song selection, "rhythmical", "quiet", "bright", "sad", "soothing" and "lonely" are displayed on the screen of the display device 7, and in addition an "other sensibility word" item is displayed. At the same time, an instruction to select one from among the displayed options is shown. The user can perform an input operation through the operation input device 2 to select one of these sensibility words or the "other sensibility word" according to the display. After step S4, the control device 6 determines whether there has been an input from the user (step S5). If there has been a user input, the control device 6 determines whether one of the sensibility words displayed has been selected, according to the output from the operation input device 2 (step S6). That is, a determination is made as to whether one of the predetermined sensibility words or the "other sensibility word" has been selected.

If one among the displayed sensibility words has been selected, the control device 6 captures the selected sensibility word (step S7), and determines whether, for the selected sensibility word, there exist personal learning values (step S8). Personal learning values are the mean value and unbiased variance, specific to the user, of each of the characteristic parameters for the selected sensibility word; the mean values and unbiased variances are computed in a step described below, and stored in a personal learning value database (fifth storage means) in the data storage device 4. If personal learning values for the selected sensibility word do not exist in the data storage device 4, a data table within the default database, determined by the user's age and gender, is selected (step S9), and mean values and unbiased variances for the characteristic parameters of the selected sensibility word are read from this data table (step S10). As shown in FIG. 5, the ten data tables are prepared in the data storage device 4. The control device 6 selects one of the data tables based on the user age and gender in step S9.

On the other hand, if personal learning values for the selected sensibility word exist in the data storage device 5, an image asking the user whether to select a song using the personal learning values is displayed on the display device 7 (step S11). The user can perform an input operation on a "YES" button or a "NO" button on the operation input device 2, according to the display, to decide whether or not to use personal learning values. After execution of step S11, the control device 6 determines whether there has been input operation of the "YES" button or of the "NO" button (step S12). If there is input operation of the "YES" button indicating that personal learning values are to be used, the mean values and unbiased variance of the characteristic parameters corresponding to the selected sensibility word are read from the personal learning value database (step S13). If there is input operation of the "NO" button indicating that personal learning values are not to be used, the control device 6 proceeds to step S9 and step S10, and the mean values and unbiased variances of the characteristic parameters corresponding to the selected sensibility word are read from the data table within the default database determined by the age and gender of the user.

Upon reading the mean values and unbiased variances of the characteristic parameters in step S10 or in step S13, the control device 6 calculates the sensibility conformance value (matching value) for each of the n songs (step S14). The sensibility conformance value for the ith song is computed as follows.

$$\begin{aligned}\text{Sensibility conformance value} = {} & (1/|a(i) - Ma|) \times (1/Sa) + \\ & (1/|b(i) - Mb|) \times (1/Sb) + \\ & (1/|c(i) - Mc|) \times (1/Sc) + \\ & (1/|d(i) - Md|) \times (1/Sd) + \\ & (1/|e(i) - Me|) \times (1/Se) + \\ & (1/|f(i) - Mf|) \times (1/Sf) + \\ & (1/|g(i) - Mg|) \times (1/Sg) + \\ & (1/|h(i) - Mh|) \times (1/Sh)\end{aligned}$$

In this formula, the degree of chord change #1 of the ith song is a(i), the degree of chord change #2 of the ith song is b(i), the degree of chord change #3 of the ith song is c(i), the beat of the ith song is d(i), the maximum beat level of the ith song is e(i), the mean amplitude level of the ith song is f(i), the maximum amplitude level of the ith song is g(i), and the key of the ith song is h(i). The selected sensibility word is A, and the mean value and unbiased variance of this sensibility word A are Ma and Sa for the degree of chord change #1, Mb and Sb for the degree of chord change #2, Mc and Sc for the degree of chord change #3, Md and Sd for the beat, Me and Se for the maximum beat level, Mf and Sf for the mean amplitude level, Mg and Sg for the maximum amplitude level, and Mh and Sh for the key.

Upon computing the sensibility conformance value for each of the n songs, the control device 6 creates a song list showing songs in order of the decreasing sensibility conformance value (step S15), and causes the display device 7 to display an image showing this song list (step S16). The screen of the display device 7 shows song names, singer names, and other song information, read from the data storage device 3. As mentioned above, the songs are listed from the one having the greatest sensibility conformance value.

If in step S6 the "other sensibility word" is selected, that is, if the user desires a song which conforms to a sensibility word other than the predetermined sensibility words, the control device 6 causes the display device 7 to display an image to request input of a sensibility word (step S17). The user can use the operation input device 2 to input, as text, any arbitrary sensibility word, according to the displayed instructions. After execution of step S17, the control device 6 determines whether text has been input (step S18). If there has been input, the control device 6 captures and stores the input text as a sensibility word (step S19). The control device 6 uses the songs #1 through #n stored in the data storage device 3 to create a random song list (step S20), and then proceeds to the step S16 (FIG. 4) and causes the display device 7 to display an image showing this song list. On the screen of the display device 7 are listed, in random order, the names, singers, and other song information of the n songs.

Figure 4:
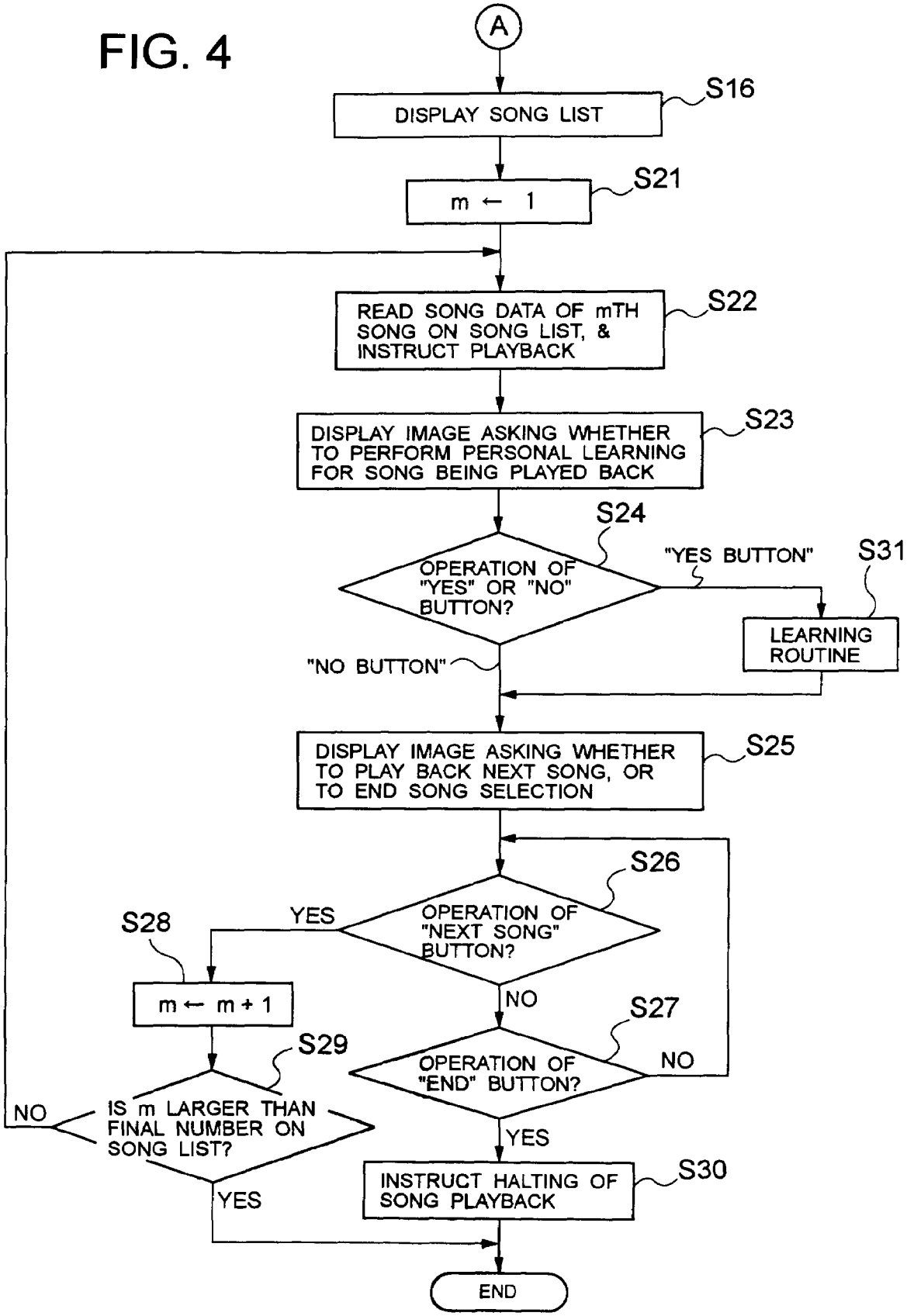

As shown in FIG. 4, the variable m is set to 1 in step S21 after step S16. Then, song data for the mth (i.e., first) song in the song list is read from the data storage device 3 and is supplied to the playback device 8 together with a playback command (step S22). The playback device 8 reproduces the song data for the mth song thus supplied, and this song data is supplied, as digital signals, to the digital/analog conversion device 9. After conversion into analog audio signals in the digital/analog conversion device 9, playback sounds for the mth song are output from the speaker 10. Thus the user can listen to the mth song.

Then, an image is displayed on the display device 7 to ask the user whether or not to perform personal learning for the song being played back (step S23). The user presses (or touches) the "YES" button or the "NO" button on the display of the operation input device 2 to select whether or not to perform personal learning for the song being played back. After execution of step S23, the control device 6 determines whether there has been operation input of the "YES" button or of the "NO" button (step S24). If there has been input of the "YES" button, indicating that personal learning is to be performed, processing proceeds to the learning routine (step S31).

If there has been input of the "NO" button indicating that personal learning is not to be performed, the display device 7 displays an image asking the user whether to proceed to playback of the next song on the list of songs, or whether to halt song selection (step S25). By operating the operation input device 2 according to the onscreen display, the user can begin playback of the next song on the displayed song list, or can halt song selection immediately. After step S25, the control device 6 determines whether there has been input operation of the "Next Song" button (step S26). If there has not been input operation of the "Next Song" button, then the control device determines whether there has been operation of the "End" button (step S27).

If there has been input of the "Next Song" button, the variable m is increased by 1 to compute the new value of the variable m (step S28), and a determination is made as to whether the variable m is greater than the final number MAX of the song list (step S29). If m>MAX, the song selection operation ends. On the occasion of this ending, the display device 7 may display an image informing the user that all the songs on the song list have been played back. On the other hand, if m≦MAX, processing returns to step S22 and the above operations are repeated.

If there has been input of the "End" button, the song playback device 8 is instructed to halt song playback (step S30). This terminates the song selection by the control device 6; but it should be noted that processing may also return to step S1 or to step S4.

Figure 6:
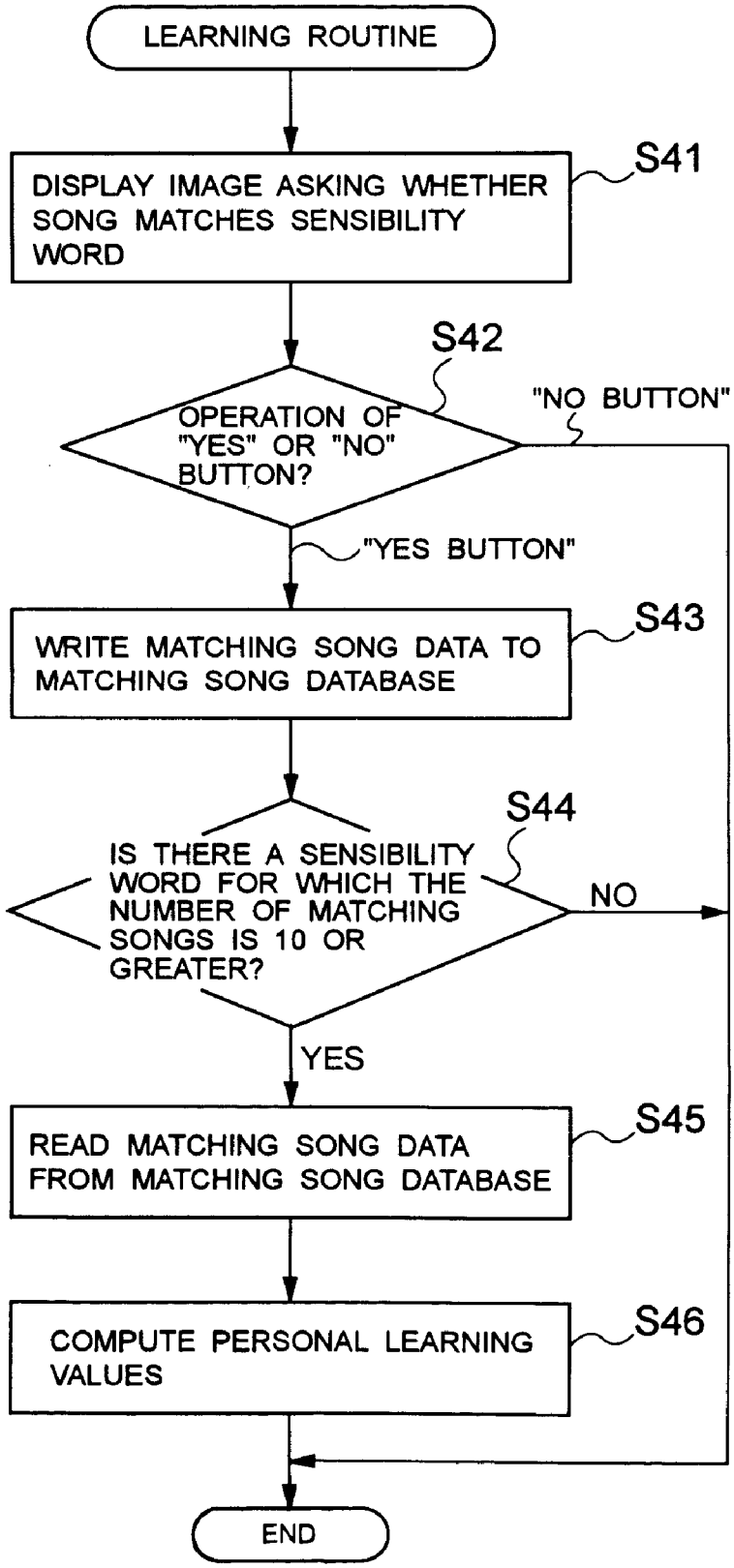
FIG. 6 is a flowchart of a learning routine.

The learning routine is now described with reference to FIG. 6. When the processing proceeds to step S31 (learning routine), the control device 6 first causes the display device 7 to display an image to ask the user whether the song currently being played back matches the sensibility word which has been selected or input (step S41). The user uses the operation input device 2 to input "YES" or "NO", according to this onscreen display, to indicate whether or not the song being played back matches the sensibility word. After step S41, the control device 6 determines whether there has been input using either the "YES" button or the "NO" button (step S42). If there is input using the "YES" button, indicating that the song being played back matches the sensibility word, matching song data of this song is written to the matching song database in the data storage device 5 (step S43). This writing is carried out for respective sensibility words. On the other hand, if there is input using the "NO" button, indicating that the song being played back does not match the sensibility word, the learning routine ends and processing goes to the step S25 (FIG. 4).

After execution of step S43, the control device 6 determines whether there is a sensibility word for which the number of matching songs written in the matching song database has reached ten (step S44). If, for example, ten songs match the sensibility word concerned, then the matching song data of this sensibility word is read from the matching song database of the data storage device 5 (step S45) and is used to compute personal learning values using statistical processing (step S46). In step S44, "10 songs" is used for determination, but another value for the number of songs may be used.

Figure 7:
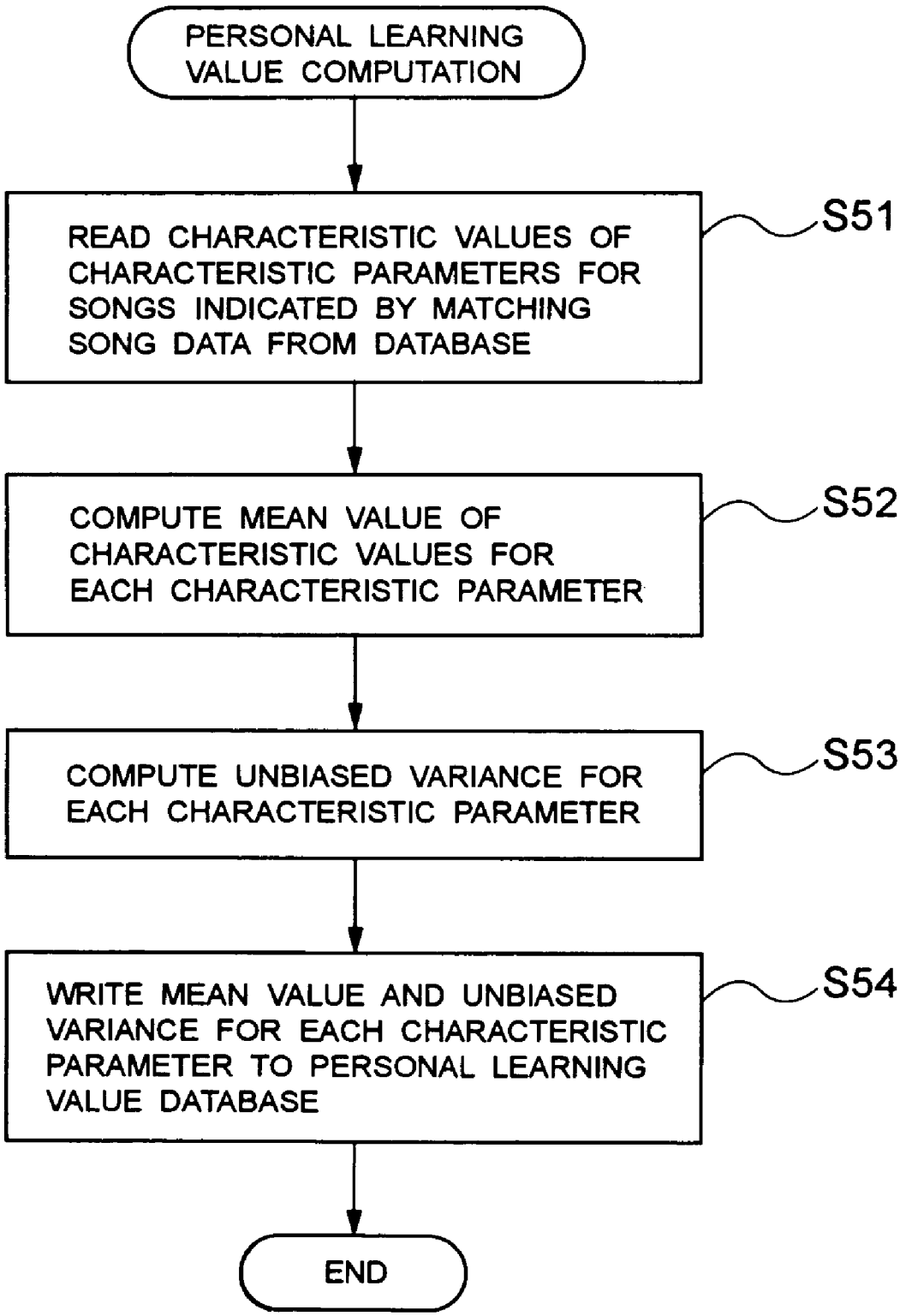
FIG. 7 is a flowchart of personal learning value computation operation; and, FIG. 8 shows a second personal learning value database including nonmatching song data.

Referring to FIG. 7, computation of personal learning values is described for a sensibility word A, for which the number of matching songs has reached 10 or greater. As shown in FIG. 7, the values of the characteristic parameters (degree of chord change #1, degree of chord change #2, degree of chord change #3, beat, maximum beat level, mean amplitude level, maximum amplitude level, and key) for the songs having the sensibility word A are read from the characteristic parameter database of the data storage device 4 (step S51), and the mean Mave of the values for each characteristic parameter are computed (step S52). Further, the unbiased variance S for each characteristic parameter is also computed (step S53). If the songs having the sensibility word A are represented by M1 to Mj (where $50 \geqq j \geqq 10$), and the values of a particular characteristic parameter for the respective songs M1 to Mj are represented by C1 to Cj, then the mean value Mave of the characteristic values C1 to Cj for this characteristic parameter can be expressed by $$\text{Mave}=(C1+C2+\ldots+Cj)/j$$

Then, the unbiased variance S of one characteristic parameter of the sensibility word A can be expressed by $$S=\{(\text{Mave}-C1)^2+(\text{Mave}-C2)^2+\ldots+(\text{Mave}-Cj)^2\}/(j-1)$$

The control device 6 writes the mean value Mave and unbiased variance S computed for each characteristic parameter into a certain storage area in the personal learning value database. The personal learning value database has storage areas for the respective characteristic parameters with respect to the sensibility word A (step S54).

After computing the personal learning values, the control device 6 returns to the step S25 (FIG. 4), and continues the operation (steps S26 to S30) as described above.

Through this song selection operation, the songs are presented to the user in the order conforming to the user's age and gender and also to a selected sensibility word. Thus, the accuracy of selection can be improved. That is, song selection is possible which accommodates differences in song images for a given sensibility word with differences in user age and gender. Further, in the song selection using personal learning values, the more the user utilizes this song selection apparatus 12, the better the song selection apparatus 12 can make a song selection in terms of the user sensitivities.

In the above described embodiment, ages are divided into the five groups of teenagers, 20's, 30's, 40's, and 50 and older; but other way of grouping the ages is also acceptable. Further, division by exact age itself is possible; or, division into finer age groups, such as the first half of each decade and the second half of each decade, may also be used, or a coarser division, for example into under-30 and 30-and-older groups, is also possible.

In the above described embodiment, a data table within the default database is selected according to both age group and gender; however, the data table within the default database may be selected according to either the age group alone or the gender alone. For example, when the user enters only the age group, the data tables for males alone may be used to select a data table in response to the input operation; or, when the user enters the gender only, either the data table for males in their 20's or the data table for females in their 20's may be selected in response to the input operation.

In the illustrated embodiment, the song selection operation for a single user is described; when performing song selection operation to select a song according to tastes common to a plurality of users, separate data tables for 20's and 30's may be prepared to calculate sensibility conformance values, and the song may be selected according to the total of these values.

In the above-described embodiment, personal properties are age and gender, but any conditions or parameters which identify human characteristics or human attributes can be used, such as race, occupation, ethnic group, blood type, hair color, eye color, religion, and area of residence.

In the above-described embodiment, songs are selected from all of the songs stored in the data storage device 3, but the songs from which song selection is performed may differ according to the user's age. For example, traditional Japanese enka ballads may be excluded when the user's age is in the teens or 20's; recent hit songs may be excluded when the user's age is 50 or above.

In the above described embodiment, the degree of chord change #1, degree of chord change #2, degree of chord change #3, beat, maximum beat level, mean amplitude level, maximum amplitude level, and the key are the characteristic parameters of songs, but other parameters are possible. Also, sensibility conformance values may be computed for at least one among the degrees of the three chord changes #1 through #3.

Degrees of chord change are not limited to the above-described degrees of chord changes #1 to #3. For example, the amount of change in the chord root, or the number of changes to other types of chords, such as changes from a major chord to a minor chord, can also be used as degrees of chord change.

In the above-described embodiment, mean values and unbiased variances are used as correction values, but other values may be used. In place of unbiased variances, for example, a multiplicative factor, variance or other weighting value to correct a degree of chord change or other characteristic value may be used. When using a variance in place of an unbiased variance, the variance of one characteristic parameter for the sensibility word A can be expressed by the following equation.

$$\text{Variance}=[(\text{Mave}-C1)^2+(\text{Mave}-C2)^2+\ldots+(\text{Mave}-Cj)^2]/j$$

When there is a "NO" button operation input indicating that the song being played back does not match the sensibility word, nonmatching song data of the song may be written to the nonmatching song database in the data storage device 5. Then, similar to computation of the personal learning values using the matching song data, nonmatching song data may be read from the nonmatching song database of the data storage device 5, and may be used to compute personal learning values through statistical processing. Personal learning values computed based on nonmatching song data may be stored in a second personal learning value database (seventh storage means), as shown in FIG. 8. The personal learning values (mean values, unbiased variances) for this nonmatching song data are reflected through the correction values αa, αb, αc, αd, αe, αf, αg, and αh when computing the sensibility conformance value as shown below.

$$\begin{aligned}\text{Sensibility conformance value} = {} & [(1/|a(i)-Ma|)\times(1/Sa)-\alpha a]+\\ & [(1/|b(i)-Mb|)\times(1/Sb)-\alpha b]+\\ & [(1/|c(i)-Mc|)\times(1/Sc)-\alpha c]+\\ & [(1/|d(i)-Md|)\times(1/Sd)-\alpha d]+\\ & [(1/|e(i)-Me|)\times(1/Se)-\alpha e]+\\ & [(1/|f(i)-Mf|)\times(1/Sf)-\alpha f]+\\ & [(1/|g(i)-Mg|)\times(1/Sg)-\alpha g]+\\ & [(1/|h(i)-Mh|)\times(1/Sh)-\alpha h]\end{aligned}$$

The correction values αa, αb, αc, αd, αe, αf, αg, and αh act so as to reduce the sensibility conformance value, and are set according to the mean values and unbiased variances which are the personal learning values based on nonmatching song data read out for each characteristic parameter.

In the above description, "rhythmical", "quiet", "bright", "sad" "soothing", and "lonely" are the sensibility words, but other sensibility words may be used. For example, "joyful" may be used.

This application is based on Japanese Patent Application No. 2004-014197 filed on Jan. 22, 2004, and the entire disclosure thereof is incorporated herein by reference.

What is claimed is:

1. A song selection apparatus for selecting a song from among a plurality of songs according to an input operation by a user, comprising:

a first storage for storing a song characteristic quantity for each of said plurality of songs;

a first setting unit for setting a personal property according to said input operation;

a second setting unit for setting a sensibility word according to said input operation; and, a selector for selecting a song having a song characteristic quantity that matches said personal property set by said first setting unit and said sensibility word set by said second setting unit from said plurality of songs, wherein said first setting unit selects and sets, as said personal property, an age-gender classification according to said input operation from a plurality of predetermined age-gender classifications, said second setting unit selects and sets said sensibility word from among a plurality of predetermined sensibility words according to said input operation, and said selector includes:

a second storage for storing a plurality of correction values for said plurality of predetermined sensibility words respectively, with respect to each of said plurality of predetermined age-gender classifications;

a reader for reading, from said second storage, a correction value that matches said age-gender classification set by said first setting unit and said sensibility word set by said second setting unit;

a correction unit for correcting the song characteristic quantity for each of said plurality of songs according to the correction value read by said reader, and for computing a sensibility conformance value for each of said plurality of songs; and, a presentation unit for presenting said plurality of songs, in order corresponding to the sensibility conformance values of said plurality of songs.

2. The song selection apparatus according to claim 1, wherein said second setting unit includes an input unit for receiving a new sensibility word other than said plurality of predetermined sensibility words, according to said input operation, and said presentation unit presents said plurality of songs in random order when said new sensibility word is received by said input unit.

3. The song selection apparatus according to claim 1, further comprising:

a matching determination unit for determining, according to a second input operation by the user, whether each said song presented by said presentation unit matches said sensibility word;

a fourth storage for storing said presented song together with said sensibility word when said presented song is determined to match said sensibility word by said matching determination unit;

a matching learning unit for computing said correction value for the sensibility word based on the song characteristic quantities of said songs stored in the fourth storage when said songs stored in said fourth storage with respect to the sensibility word becomes equal to or more than a prescribed number;

a fifth storage for storing said correction value computed by said matching learning unit in association with said sensibility word; and, a learning determination unit for determining whether the correction value for said sensibility word set by said second setting unit exists in said fifth storage; and wherein when said learning determination unit determines that the correction value for said sensibility word exists in said fifth storage, said reader reads the correction value from said fifth storage, instead of from said second storage.

4. The song selection apparatus according to claim 3, wherein said reader switches reading of the correction value from said second storage to said fifth storage according to a third input operation by the user.

5. The song selection apparatus according to claim 3, further comprising:

a sixth storage for storing said presented song, as a nonmatching song, together with said sensibility word when said matching determination unit determines that said presented song does not match said sensibility word;

a nonmatching learning unit for computing said correction value for the sensibility word based on the song characteristic quantities of said nonmatching songs stored in the sixth storage when said songs stored in said fourth storage with respect to the sensibility word has already reached the prescribed number; and, a seventh storage for storing said correction value computed by said nonmatching learning unit, in association with said sensibility word; and wherein said correction unit reads the correction value of said sensibility word from said seventh storage, and corrects said sensibility conformance value according to the correction value.

6. The song selection apparatus according to claim 1, wherein said plurality of sensibility words include at least two of "rhythmical", "quiet", "bright", "sad" "soothing", "lonely" and "joyful".

7. The song selection apparatus according to claim 1, wherein said correction value for the sensibility word includes a mean value and unbiased variance of said song characteristic quantities of the songs associated with the sensibility word.

8. A method of selecting a song from among a plurality of songs according to an input operation by a user, comprising:

storing a song characteristic quantity of each of said plurality of songs;

setting a personal property according to said input operation;

setting a sensibility word according to said input operation; and, selecting a song having a song characteristic quantity that matches said personal property and said sensibility word, wherein said personal property is an age-gender classification chosen from a plurality of predetermined age-gender classifications, and said sensibility word is chosen from among a plurality of predetermined sensibility words, and the method further comprising:

preparing a plurality of correction values for said plurality of predetermined sensibility words respectively, with respect to each of said plurality of predetermined age-gender classifications;

reading a correction value that matches said age-gender classification and said sensibility word;

correcting the song characteristic quantity for each of said plurality of songs according to the correction value, and for computing a sensibility conformance value for each of said plurality of songs; and, presenting said plurality of songs, in order corresponding to the sensibility conformance values of said plurality of songs.

9. The method according to claim 8, further comprising:

receiving a new sensibility word other than said plurality of predetermined sensibility words; and presenting said plurality of songs in random order when said new sensibility word is received.

10. The method according to claim 8, wherein said song characteristic quantity includes a degree of chord change for each of said plurality of songs, and at least one characteristic parameter indicating a characteristic other than said degree of chord change for each of said plurality of songs, and the method further comprises:

preparing a correction value to each of said degrees of chord change and said at least one characteristic parameter for each of said plurality of sensibility words, with respect to each of said plurality of predetermined age-gender classifications;

finding said correction value for each of said degrees of chord change and said at least one characteristic parameter, that matches said age-gender classification and said sensibility word;

correcting said degree of chord change and said at least one characteristic parameter for each of said plurality of songs by using said correction values, and for taking a sum of correction results as a sensibility conformance value for the song concerned; and, presenting said plurality of songs, in order according to the sensibility conformance values of said plurality of songs.

11. The method according to claim 10 further comprising:

preparing playback sound data of each of said plurality of songs, and reading the playback sound data from said third storage in the order determined by said sensibility conformance values of said plurality of songs, and for generating sounds according to the playback sound data.

12. A song selection apparatus for selecting a song from among a plurality of songs according to an input operation by a user, comprising:

a first storage for storing a song characteristic quantity for each of said plurality of songs;

a first setting unit for setting a personal property according to said input operation;

a second setting unit for setting a sensibility word according to said input operation; and, a selector for selecting a song having a song characteristic quantity that matches said personal property set by said first setting unit and said sensibility word set by said second setting unit from said plurality of songs, wherein said first storage stores a degree of chord change for each of said plurality of songs, and at least one characteristic parameter indicating a characteristic other than said degree of chord change for each of said plurality of songs, as said song characteristic quantity;

said first setting unit selects and sets as said personal property an age-gender classification according to said input operation from a plurality of predetermined age-gender classifications; and, said selector includes:

a second storage for storing a correction value to each of said degrees of chord change and said at least one characteristic parameter for each of said plurality of sensibility words, with respect to each of said plurality of predetermined age-gender classifications;

a reader for reading, from said second storage, said correction value for each of said degrees of chord change and said at least one characteristic parameter, that matches said age-gender classification set by said first setting unit and said sensibility word set by said second setting unit;

a correction unit for correcting said degree of chord change and said at least one characteristic parameter for each of said plurality of songs by using said correction values read by said reader, and for taking a sum of correction results as a sensibility conformance value for the song concerned; and, a presentation unit for presenting said plurality of songs, in order according to the sensibility conformance values of said plurality of songs.

13. The song selection apparatus according to claim 12, wherein said presentation unit includes:

a third storage for storing playback sound data of each of said plurality of songs, and a sound output unit for reading the playback sound data from said third storage in the order determined by said sensibility conformance values of said plurality of songs, and for generating sounds according to the playback sound data.

14. The song selection apparatus according to claim 12, further comprising:

a matching determination unit for determining whether the song presented by said presentation unit matches said sensibility word, according to a second input operation by the user;

a fourth storage for storing said presented song together with said sensibility word, when said matching determination unit determines that said presented song matches said sensibility word, with respect to each of said degrees of chord change and said at least one characteristic parameter;

a matching learning unit for computing said correction value for each of said degree of chord change and said at least one characteristic parameter for the sensibility word when said songs stored in said fourth storage with respect to the sensibility word is equal to or greater than a prescribed number, based on values of said degrees of chord change and said characteristic parameters of said songs stored in the fourth storage;

a fifth storage for storing said correction values computed by said matching learning unit, in association with said sensibility word; and, a learning determination unit for determining whether the correction value for said sensibility word set by said second setting unit exists in said fifth storage; and wherein when said learning determination unit determines that the correction value for said sensibility word exists in said fifth storage, said reader reads the correction values for said sensibility word from said fifth storage instead of from said second storage.

15. The song selection apparatus according to claim 12, wherein said degree of chord change for each said song is at least one among the number of chords per minute in the song concerned, the number of types of chords used in the song concerned, and the number of change points, such as discord, which change an impression of the song concerned during the chord progression.

16. The song selection apparatus according to claim 12, wherein said at least one characteristic parameter of the song concerned includes any among a number of beats per unit time, maximum beat level, mean amplitude level, maximum amplitude level, and key of the song.

17. The song selection apparatus according to claim 12, wherein said plurality of sensibility words include at least two of "rhythmical", "quiet", "bright", "sad" "soothing", "lonely" and "joyful".

* * * * *